United States Patent [19]

Alder et al.

[11] 4,170,533

[45] * Oct. 9, 1979

[54] REFRACTORY ARTICLE FOR ELECTROLYSIS WITH A PROTECTIVE COATING MADE OF CORUNDUM CRYSTALS

[75] Inventors: Hanspeter Alder, Flurlingen; Hans Boving, Corcelles, both of Switzerland

[73] Assignee: Swiss Aluminium Ltd., Chippis, Switzerland

[ * ] Notice: The portion of the term of this patent subsequent to Sep. 20, 1994, has been disclaimed.

[21] Appl. No.: 818,112

[22] Filed: Jul. 22, 1977

Related U.S. Application Data

[62] Division of Ser. No. 687,636, May 18, 1976, Pat. No. 4,049,511.

[30] Foreign Application Priority Data

May 30, 1975 [CH] Switzerland ..... 6979/75

[51] Int. Cl.[2] ..... C25C 3/08; C25D 17/02; C25C 3/10

[52] U.S. Cl. ..... 204/243 R; 204/297 R

[58] Field of Search ..... 204/290 R, 297 R, 243 R

[56] References Cited

U.S. PATENT DOCUMENTS

| | | | |
|---|---|---|---|
| 3,829,374 | 8/1974 | Kugler et al. | 204/290 R |
| 3,859,198 | 1/1975 | Emblem | 204/290 R |
| 4,008,144 | 2/1977 | Toubai et al. | 204/290 R |
| 4,054,500 | 10/1977 | Parent | 204/181 N |

*Primary Examiner*—Howard S. Williams
*Attorney, Agent, or Firm*—Robert H. Bachman

[57] ABSTRACT

A molten salt charge as used in the electrolysis of aluminum contains aluminum oxide in excess of the eutectic composition and is cooled at a surface colder than the melt in such a way that the aluminum oxide precipitates onto this surface in the form of corundum crystals. Such a layer of crystals provides chemical and electrical insulation to the cooling surface under the corrosive conditions produced by the charge.

8 Claims, 2 Drawing Figures

REFRACTORY ARTICLE FOR ELECTROLYSIS WITH A PROTECTIVE COATING MADE OF CORUNDUM CRYSTALS

This is a division of our application Ser. No. 687,636, filed on May 18, 1976, U.S. Pat. No. 4,049,511.

The invention concerns a process for the manufacture of a compact, crust-like protective material which insulates the cooling surface underneath it, both chemically and electrically, from strongly corrosive conditions. This is achieved by allowing a molten salt mixture containing aluminum oxide in excess of the eutectic composition to cool so that it forms a layer of corundum crystals.

In the electrolysis of aluminum the pot contains both the molten electrolyte and the liquid aluminum which lies at the bottom of the pot and which serves also as the cathode. These pots have the disadvantage that their carbon lining is rapidly attacked by the strongly corrosive molten salt in the region of the side-wall.

Because of the relatively low temperature outside, a temperature gradient is established in the side wall which leads to the formation of a crust of solidified electrolyte as soon as the temperature there falls below the liquidus of the bath composition. This crust protects the carbon lining on the wall from chemical attack.

If the aluminum oxide content of the melt lies under the eutectic composition then the salt e.g. cryolite which is used as the solvent, begins to crystallize when the liquidus temperature is reached while the dissolved aluminum oxide is enriched until the eutectic temperature is reached. In this concentration range therefore no pure aluminum oxide can be precipitated.

The eutectic composition of cryolite and aluminum oxide which will be discussed as representative of the normal aluminum oxide bearing melts, is around 90% cryolite and 10% $Al_2O_3$ (weight percent). In the case of a typical $Al_2O_3$ concentration of 3–6% in cryolite as is normal in the electrolytic production of aluminum consequently, independent of the cooling rate, no crystallization of $Al_2O_3$ occurs, but always cryolite.

Because of the low heat of fusion (79.2 cal/g=16.6 kcal/Mol) given off by the cryolite when it rises above the liquidus line and because of the relatively low melting point of 1000° C., this crust reacts quickly to any changes in temperature, charge composition or cooling at the outside. The constant formation and resolution of solid cryolite leads to rapid fluctuations in the thickness of the crust which seldom therefore corresponds to the thickness required for optimum operation of the pot.

If pots are used in which the anode and cathode are not, as in the normal case, positioned horizontally facing each other but instead where the electrodes are placed bipolar in series or parallel, then the problem of the cryolite crust becomes more pronounced.

In pots with a plurality of bipolar electrodes higher voltages and lower current are employed. With a pot wall which is more or less electrically conductive a short circuit can, at least in part, take place and thus give rise to a local electrolysis between one or more electrode plates and the lining.

Carbon linings are not suitable for such pots. Substitute materials however have to fulfil a whole series of contradicting properties viz.

withstand temperatures up to 1000° C.
withstand temperature changes well
have no through porosity withstand molten salts and molten aluminum up to 1000° C.
withstand halide vapours and gases released at the anodes
have good electrical insulation properties in the solid state
be economic in its manufacture and its use.

Refractory materials such as oxides, carbides, nitrides and borides have been proposed as insulating and protective materials for this purpose but none of these meets all the above requirements.

More interesting propositions therefore have been those in which the insulating material is made out of components of the electrolyte.

Thus for example the French Pat. No. FR 1 363 565 describes brick for lining pots whereby the brick contains 75–80 wt % aluminum oxide, and the remainder principally cryolite. The constituents are heated to 1350–1450° C. after mixing, and then quickly cooled. The bricks have indeed a high melting point, but are porous and begin to soften as low as about 950° C. In the electrolytic cell the bricks absorb electrolyte which produces an increase in weight of 25–40%; at 980° C. the electrical resistance of the pot lining is only 5Ω/cm. This material in French Pat. No. FR 1 363 565 is therefore problematic with respect to several of the stated requirements.

In the French Pat. No. FR 1 530 269 it has been found that a refractory pot lining with 60–85% aluminum oxide involves high energy consumption because of the high melting point and the preparatory mixing operation and also incurs difficulties in the operation of the process. It is therefore suggested that in a pot for electrolysis of aluminum oxide having a refractory lining, at least a part of the lining should consist of pure, synthetically produced or natural cryolite with a melting point between 970° and 1000° C. A process for casting these cryolite bricks is also described. The previously described problem cannot however be solved this way since even a small increase in temperature causes the cryolite in the lining to go into solution.

In Swiss Pat. No. CH 504 389 it has been suggested to make a dispersion of coal grit in the fire-brick of cryolite and alumina (FR 1 363 565) or of pure cryolite (FR 1 530 269). This does indeed mean that the stability of large surfaced, vertical walls can be improved but on the other hand the alumina-cryolite problem still remains.

The object of the invention presented here is therefore to provide a process for the manufacture of a compact crust which insulates the underlying cooling surface both chemically and electrically in corrosive conditions, in particular in the electrolysis of aluminum in a molten electrolyte, by which process the above mentioned difficulties are avoided, the formation of a pasty phase is prevented, and all the listed requirements for an insulating material are met.

This objective is by way of the invention fulfilled in that a molten salt charge containing an amount of aluminum oxide which is above the eutectic composition, i.e. a hypereutectic composition, is cooled on the surfaces which are cooler than the melt, in such a way that aluminum oxide is deposited on the surfaces in the form of corundum crystals which are preferably continuous throughout the layer.

The corundum crystals formed are indeed not completely insoluble in the electrolyte but do not suffer in terms of their protective nature from brief changes in melt composition, temperature or cooling from outside.

The crystals of corundum, in most cases needle-like in shape, grow intimately into one another or are held together by a small amount of solidified material of eutectic composition. They exhibit mainly the following differences from a phase of solidified electrolyte material e.g. cryolite:

Corundum is an insulator i.e. the electrical resistance is high, approximately of the order of $10^6\Omega$/cm. Cryolite on the other hand, with a specific electrical resistance of approx. $5\Omega$/cm can be looked on as a conductor.

the heat of solution of corundum is very high (106 kcal/Mol) while that of cryolite is only 16.6 kcal/Mol. Thus corundum is much less sensitive to changes in the temperature of the melt.

The sensitivity of corundum to thermal shock is very slight, in contrast with cryolite.

The temperature of the cooling surfaces is preferably only slightly lower than that of the melt in order that the melt does not break down as a result of too rapid cooling to solidify as a heterogeneous mixture of solvent material and $Al_2O_3$. The heat flow should be so small that precipitation of pure oxide occurs in the temperature range between the liquidus and solidus lines.

The heat conducted away must be at least as large as the heat of solution of aluminum oxide in the molten salt in question.

The heat of solution of $\gamma$-$Al_2O_3$ in cryolite containing 5–12 wt % $Al_2O_3$ has been determined as 146 kJ/Mol at 1000° C. or 0.397 Wh/g (Rev. Int. Htes Temp et Refract., 11, 125–132, 1974). On the precipitation of 1 $cm^3$ of corundum with a density of 3.97 g/$cm^3$ from the electrolyte, 1.58 Wh of heat has to be removed.

In order to form a crust of corundum crystals a melt, which has an $Al_2O_3$ content above the eutectic concentration, is employed and the temperature of which lies usefully just above the liquidus line for the $Al_2O_3$ concentration in question.

For the binary cryolite-$Al_2O_3$ system, which as mentioned above is discussed as representative of other melts, the following charge temperatures lying just above the liquidus liquides line are usefully maintained:

| Wt % $Al_2O_3$ | Charge Temperature (°C.) |
|---|---|
| 11 | 970 |
| 15 | 1050 |
| 16 | 1070 |

In the case of an $Al_2O_3$ content higher than 16 wt % the liquidus line rises steeply.

If additions such as alkali or alkali earth fluorides and/or oxides are made to this binary system, then slightly different data apply i.e. the charge temperature to be used is displaced to a greater or lesser extent.

The temperature of the cooled supporting surfaces is usefully slightly below the liquidus line. This way very slow precipitation and good crystal growth is achieved.

In the case of the binary cryolite-$Al_2O_3$ system which is used extensively in industry, the $Al_2O_3$ content lies between the eutectic composition and 20 wt %, preferably between 10 and 16%. The charge temperature lie, depending on the $Al_2O_3$ content, between 920° C. and 1100° C. If desired an addition of 5 wt % $AlF_3$ is used. Our trials have shown that the best results are obtained with a heat flow between 0.1 and 20 W per $cm^2$ of cooling surface, in particular between 1 and 10 W per $cm^2$. If more heat is drawn off then the melt solidifies on the cooling surface as a whitish crust and primary crystals of corundum precipitate out only on the interface between solid electrolyte and the melt. The result of this is that the cryolite phase dissolves if the temperature of supporting surface rises only slightly. If however the given temperature range for the charge is employed then there forms a continuous protective layer of corundum crystals, which are in part intimately grown into each other, and partly held together by a small amount of solidified eutectic from the melt.

If for example a heat flow is adjusted to 5 W/$cm^2$ then the formation of a 1 cm thick protective layer takes theoretically 0.3 hour. In practice however the formation of the crust takes place much more slowly. Deposition times of 10 to 100 hours produce excellent coatings and are therefore used by way of preference.

The heat drawn off from the cooling surfaces can be led off by any desirable gas or liquid such as water, molten salts or metals, however air is preferred here.

The protective corundum crust is to a great extent insensitive to brief, small changes in charge temperature and cooling rate. When the protective layer has reached a certain thickness, then the cooling can be substantially reduced or interrupted. The upper limit for the application of cooling is around 15 hours.

An essential feature of the invention is that the cooling surface is made of a metal, a metallic alloy, ceramic materials or carbon.

These materials are either poorly or not at all resistant at temperatures of 950°–1000° C. to molten halide salts such as cryolite, fluoride vapour and molten aluminum. A surface of poorly resistant material protected by a crust of corundum however can be kept in use for any length of time without corrosive action being discernible. At the same time these surfaces are electrically insulated by the corundum crust. The supporting surfaces can be of simple or complicated geometric shape.

In a simple case of the cryolite-aluminum oxide system the corundum crust is formed by taking an electrolyte of aluminum oxide content above the eutectic composition, pouring it into a pot and controlling the cooling so that the dissolved aluminum oxide solidifies in the form of plates of corundum crystals on the cooled surfaces. The residual electrolyte in the pot is less rich in aluminum oxide and during the cooling continually approaches the eutectic composition. It is poured off before it reaches the eutectic temperature at which it would solidify. The cooling surfaces coated with a crust of corundum can then e.g. be used for lining aluminum reduction cells or, in an electrolyte with an $Al_2O_3$ content which lies below the eutectic composition, as electrode frames, whereby the surface under the crust is cooled continuously or discontinuously by controlling the supply of the cooling medium in such a way that the protective layer is preserved. It is however particularly useful to carry out the electrolysis of aluminium oxide in a charge which has an $Al_2O_3$ content above the eutectic composition i.e. the electrolysis can take place with continuous or discontinuous cooling, in the same molten charge or with the same composition as that in which the corundum crust was formed.

An exemplified embodiment of the device for carrying out the process for the production of a compact, adherent protective crust is explained in greater detail with the help of an electrode frame shown schematically in the accompanying figure. Such electrode frames are required for example when the aluminum is not produced by the usual method with a consumable carbon anode and a liquid aluminium cathode, but instead by a method in which anode gas is formed at a non-consumable electrode and the aluminum precipitates out on a solid electrode.

FIG. 1 shows the front side of the electrode frame with a window opening, while

Figure 1:
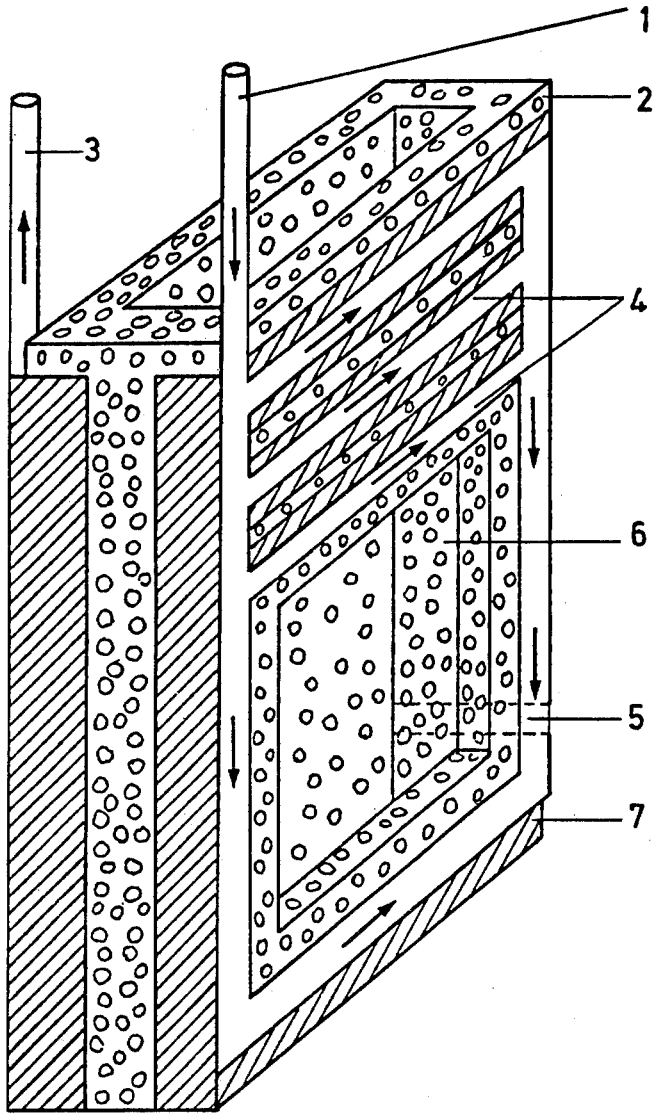
Figure 2:
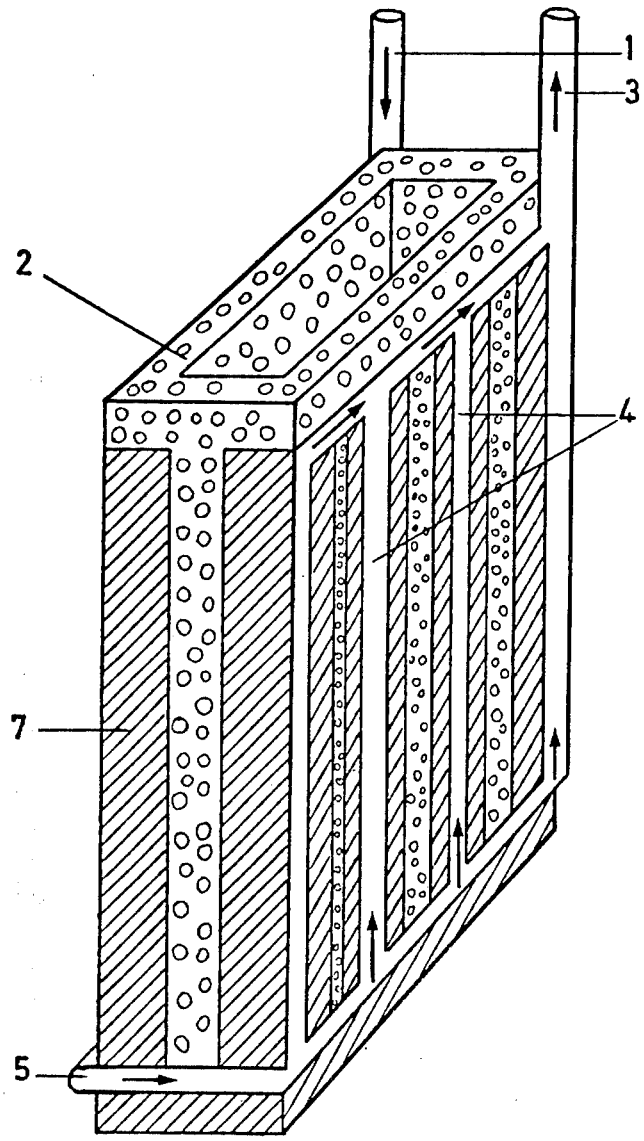
FIG. 2 shows the back of the frame.

The electrode frame 2 shown here consists of material which, under the conditions prevailing during the electrolysis of aluminum, is relatively stable and is a poor electrical conductor. It is made preferably out of a refractory nitride or oxide such as boron nitride, silicon nitride, aluminum oxide or magnesium oxide which are made into a certain shape by techniques which are well known in the technology of ceramics. In order to make a decisive improvement in the stability of these ceramic materials a cooling system is provided on the electrode frame to allow the formation of a crust of corundum. The cooling system consists of at least one input pipe 1 and output pipe 3 for the cooling medium, and a number of cooling pipes 4 which are arranged either parallel or in series. The cooling pipes of the front and back of the electrode frame are joined by a connecting pipe 5. This way approximately the same quantity of heat per unit surface area, with respect to the surface of the electrode frame, is drawn off. These cooling tubes are made preferably out of heat resistant metals or alloys e.g. steel, nickel, alloys of nickel or chrome-nickel steels. Pipes of rectangular, round or preferably oval cross section are chosen for the cooling system in order to obtain a layer of crust which is as uniform as possible on the electrode frame. The adhesion of the protective coating of corundum crystals to the cooling surface can be improved by roughening this surface before the coating process, by mechanical, electrical or chemical means or by welding a wire mesh to the surface. In order to increase the cooling surface and to improve the bonding, cooling fins 7 can be secured to the cooling tubes 4, in particular by welding. In the actual interior of the electrode frame a sheet which is not shown can be introduced and which is joined to the window 6 by the molten electrolyte.

In the case of another process not shown here the electrode frame is made of metal. Before making the protective crust at least one plate is fixed at a distance from the metal frame. This way a crust which is chemically and electrically insulating can form on both sides of the frame (outside and inside) and which at the same time gives the electrode-plate good anchorage.

Finally one can dispense completely with the electrode frame; by cooling the appropriate positions the electrode plates can be provided with a crust which thus replaces a pre-shaped frame.

EXAMPLE 1

A tubular loop made of Inconel 600 with 5 mm outer diameter and 3 mm inner diameter as immersed in a cryolite melt heated to 990° C. and containing 5 wt % aluminum tri-fluoride and a variable amount of aluminum oxide. The loop was cooled with air, the flow rate of which was 3 l/min at normal temperature (25° C.) and pressure (760 mmHg). At the end of the trial, after 24 h the crust formed was measured at the start, middle and end of the 50 cm long loop. Table 1 shows a summary of the data of the trials in which various parameters such as the aluminum oxide content in the cryolite melt and the duration were changed. On the other hand the aluminum tri-fluoride content of the cryolite melt and the temperature of the melt were kept constant.

The following conclusions can be drawn from table 1:

In the trials 1 and 2 a whitish crust, apparently solidified cryolite, resulted and in which no corundum crystals could be seen even on examining under the microscope at a magnification of 500 times.

In trial number 3 many small crystals up to a size of 1 mm formed but they were mixed in with a great deal of solidified melt the composition of which lay close to the eutectic.

TABLE I

| Run (No) | $Al_2O_3$ content of the charge (%) | Duration of the run (h) | Air temperature (°C.) Exit | Crust thickness (mm) on the tube immersed in the melt Start | Middle | End | Corundum crystals | Heat removed by the air ($W/cm^2$) Start | Middle | End | Total heat removed (W) |
|---|---|---|---|---|---|---|---|---|---|---|---|
| 1 | 0 | 24 | 520 | 2,2 | 0 | 0 | None | 8,5 | 6,9 | 5,3 | 545 |
| 2 | 5 | 24 | 590 | 1,5 | 0,8 | 0,5 | None | 10,1 | 7,9 | 5,7 | 622 |
| 3 | 10 | 24 | 598 | 4 | 2 | 0 | Yes | 10,6 | 8,3 | 6,0 | 652 |
| 4 | 14 | 50 | 567 | 5,5 | 2 | 1 | Yes | 9,6 | 7,6 | 5,6 | 597 |

Charge: Cryolite + 5% $AlF_3$, temperature 990° C.

In trial number 4 some long needles (7–8 mm long and 2×3 mm base area) and crystals of 4 mm in length and with a base area of 3×3 mm were found. By X-ray diffraction and microprobe analysis it was proved that these are crystals of corundum. These crystals were coloured violet to black by trapped iron or chromium oxide. Between the crystals there was a maximum of 20 volume percent of solidified melt. In general such inclusions were substantially below the maximum content and decreased quickly with increasing distance from the cooling surface.

The rate of formation of the crystals, which can be calculated from the crust thickness after a certain time, is approximately proportional to the heat removed. At the start of the cooling tube which had been immersed, where the temperature gradient between the air and the melt is greatest, a thicker crust had formed than at the end where this temperature gradient is smaller, because the air is heated continuously as it flows through the pipe and can therefore remove less and less heat. The crust formed at the beginning of the cooling tube contained relatively small corundum crystals and many regions of trapped solidified melt. At the end of the tube larger crystals with less trapped melt had been formed.

The quality of the insulating material which is called crust here, expressed as the proportion and size of the corundum crystals in the crust, is therefore apparently best when very little heat is extracted over as long an interval as possible. In order that a useful crust formation is formed within a certain time e.g. 50 hours in a cryolite melt at 990° C. and containing approximately 14 wt % of aluminum oxide, it is necessary to have heat extraction at approx. 5 W/cm$^2$, with reference to the outer surface of the tube.

EXAMPLE 2

The uncooled protective crust formed in accordance with example 1 was subjected to a solubility test in a cryolite melt. Several samples of commercial aluminum oxide were used form comparison purposes. The sample pieces, each about 10 g in weight were placed in 100 ml nickel crucibles and suspended in a cryolite melt by means of nickel wire. The nickel crucibles were perforated on purpose, in order to ensure free flow of the cryolite melt around the sample. The cryolite melt, about 1 liter in volume containing 11 wt % $Al_2O_3$ and 5 wt % $AlF_3$ was held in a graphite crucible of 110 mm internal diameter and 179 mm deep. The results are summarised in table II.

This table shows that an uncooled crust of corundum, even at temperatures well above the liquidus line (liquidus point for the melt composition used: 950° C., melt temperature 995°±5° C.), suffers a weight loss of several % after 16 hours, but then remains stable for a longer time. The 16% weight loss in the corundum crust comes mainly from the solidified trapped electrolyte enriched on the inner side of the crust and which runs out at the high temperature of the test. This weight loss can therefore not be compared directly with that of the commercial, sintered $Al_2O_3$ samples in which the weight loss corresponds to a real loss.

Thus the weight loss of the corundum crust remained constant for between 5 and 15 hours, while the loss in the sintered $Al_2O_3$ sample continued.

TABLE II

| Material | Sintering temperature (°C.) | Porosity (%) | weight loss (wt %) after 5 h | 15 h |
|---|---|---|---|---|
| Corundum crust (example 1) | | | 16 | 16 |
| $Al_2O_3$ | 1600 | 6,0 | 24 | 100 |
| $Al_2O_3$ | 1800 | 0,1 | 21 | 34 |
| $Al_2O_3$ + 2% $Cr_2O_3$ | 1600 | 0,3 | 16 | 30 |
| $Al_2O_3$ + 2% $TiO_2$ | 1600 | 0,1 | 17 | 22 |

Charge composition: 84% cryolite, 5% $AlF_3$, 11% $Al_2O_3$,
temperature: 995 ± 5° C.,
weight of sample: 10 g

EXAMPLE 3

The purpose of this example was to make use of the results obtained in examples 1 and 2, by carrying out the electrolysis of aluminum oxide in a molten charge.

Steel tubes of Incoloy 825 with 13.7 mm outer diameter and 9.2 mm inner diameter were welded together in such a way that between two lengthwise running tubes which serve to supply and remove the air, 6 cross tubes each 19.2 cm in length lay parallel to and next to each other. The cooling medium flowed therefore from the supply pipe in six individual streams, joined up again and was finally led off through the run off pipe. In order to make this example as informative as possible the distance between the cross tubes was varied (see table III). This system of tubes was rolled flat until the tubes had an eliptical outer diameter of 16 mm in the direction of the cooling plane and approx. 12 mm in the plane perpendicular to this. This deformation of the tubes reduces the distance between the transverse running tubes to the size given in table III. In order to increase the cooling area and at the same time to bridge the gap between the tubes, at least in part, cooling fins were welded on to the cross tubes. Three nickel sheets 40 mm in length and 23 mm wide were welded, at equal distances apart, between the tubes 2 and 3, and five nickel sheets 23 mm in length and 20 mm wide between the pipes 4 and 5. A cooling sheet 19.2 cm long and 9 mm wide was welded onto one side of pipe 5, lengthwise in the direction of pipe 6, and in a similar manner one sheet each of the same dimension on to both sides of pipe 6.

The whole cooling system was sand blasted and then slowly immersed in a cryolite melt at 980°-1000° C. and containing 12% aluminum oxide. Only when the cooling system had reached the temperature of the melt was the air stream allowed to flow and this at 360 l/min with respect to normal temperature and pressure (NTP). The temperature of the hot exit air was between 330° and 340° C. After 64 hours the cooling system was removed from the melt and examined. A fairly uniform sheet of approx. 23×20 cm in which all spaces had been bridged over, had formed. The crust contained crystallised aluminum oxide from the melt in the form of corundum crystals which measured up to 7 mm in length along their sides. Only little solidified cryolite was found between the corundum crystals; the volume amounted to less than 10%. It must be stressed that neither the Incoloy pipes nor the welds showed any sign of corrosive attack.

TABLE III

| Transverse pipes | Space (mm) | Space after rolling (mm) |
|---|---|---|
| 1 and 2 | 12 | 10 |
| 2 and 3 | 25 | 23 |
| 3 and 4 | 16 | 14 |
| 4 and 5 | 25 | 23 |
| 5 and 6 | 20 | 18 |

What we claim is:

1. An article of refractory material carrying a substantially continuous, compact, adherent protective coating consisting essentially of corundum crystals which are needle-like in shape and which are in part intimately grown into each other and in part held together by solidified aluminum oxide eutectic material.

2. An article according to claim 1 wherein said refractory material is a carbon pot adapted to contain an alumina-containing electrolysis melt, said pot carrying an interior coating of corundum.

3. An article according to claim 1 wherein said refractory material is an electrode frame for use in an alumina-containing electrolysis melt, said frame carrying a coating of corundum.

4. An article according to claim 1 wherein said coating is substantially uniform.

5. An article according to claim 1 wherein said refractory material is electrically insulated by said corundum coating.

6. An article according to claim 1 wherein said refractory material is poorly resistant to molten halide salts at elevated temperatures.

7. An article according to claim 1 wherein said refractory material is a poor electrical conductor.

8. An article according to claim 1 wherein the surface of said refractory material is roughened before coating.

* * * * *